United States Patent [19]

Roth

[11] Patent Number: 5,005,727

[45] Date of Patent: Apr. 9, 1991

[54] DUAL PURPOSE WASTE RECEPTACLE

[76] Inventor: Karen L. Roth, 100 Parkview Pl., Hampton, Va. 23664

[21] Appl. No.: 512,464

[22] Filed: Apr. 23, 1990

[51] Int. Cl.[5] ..... B65D 1/24

[52] U.S. Cl. ..... 220/404; 220/326; 220/94 R; 220/909; 220/532; 383/33

[58] Field of Search ..... 220/22, 1 T, 404, 94 R, 220/326; 383/33

[56] References Cited

U.S. PATENT DOCUMENTS

| | | | |
|---|---|---|---|
| 760,434 | 5/1904 | Donohue | 220/22 |
| 1,275,695 | 8/1918 | Iverson | 220/22 |
| 1,294,942 | 2/1919 | Orawiec | 220/94 R |
| 2,369,902 | 2/1945 | Krueger | 220/94 R |
| 2,380,443 | 7/1945 | Ingle | 220/326 |
| 2,747,388 | 5/1956 | Dolar | 220/22 |
| 2,873,880 | 2/1959 | Poulos | 220/94 R |
| 3,904,218 | 9/1975 | Kostic | 220/1 T |
| 3,997,072 | 12/1976 | Guth | 220/94 R |
| 4,111,476 | 9/1978 | Jacobs | 220/326 |
| 4,164,300 | 8/1979 | Raczynski et al. | 220/94 R |
| 4,202,574 | 5/1980 | Redmayne | 220/326 |
| 4,589,567 | 5/1986 | Pircher | 220/326 |
| 4,729,489 | 3/1988 | Papaianni | 220/404 |
| 4,750,638 | 6/1988 | Sosower | 220/1 T |
| 4,753,367 | 6/1988 | Miller et al. | 220/404 |
| 4,834,262 | 5/1989 | Reed | 220/404 |
| 4,867,328 | 9/1989 | McCarthy | 220/1 T |
| 4,874,111 | 10/1989 | Heller | 220/1 T |
| 4,905,853 | 3/1990 | Strawder | 220/1 T |

*Primary Examiner*—Stephen Marcus
*Assistant Examiner*—S. Castellano
*Attorney, Agent, or Firm*—Wallace J. Nelson

[57] ABSTRACT

A dual purpose waste receptacle including a trash container having an open and a closed end and provided with a removable top, having a pair of oppositely disposed swinging doors, releasably covering the open end. The top open end of the container has a transverse divider disposed therein and provided with a pair of spaced vertically extending edges defining an elongated open channel extending the length thereof and facing the open top end of the trash container. The vertically extending divider edges receive a portion of the top of each of two trash can liners in overlapping relationship thereon and frictionally receive a crossbar carried by the removable top to assist in retaining the top and the trash can liners in position. A pair of diametrically disposed handles are carried by the removable top and engage under the overhanging lip exterior surface of the can top. The divider channel also supports at least one relatively thick sheet of plastic depending therefrom and serving to maintain the two can liners linearly separated.

6 Claims, 2 Drawing Sheets

DUAL PURPOSE WASTE RECEPTACLE

FIELD OF THE INVENTION

This invention relates generally to waste collection and relates specifically to a waste receptacle having separate compartments for receiving recyclable and non-recyclable waste, as accumulated.

BACKGROUND OF THE INVENTION

There is a definite desire and need to improve the efforts to recycle more of the solid waste material discarded each day by our citizens. Most discarded paper items, as well as some glass, aluminum and plastic products, can be recycled if properly separated and sorted. A number of waste sorting containers have been proposed, some are effective but all have room for improvement. In using trash can liners in side-by-side relationship in a waste disposal can, one or both of the liners may be accidentally ruptured and cause mixing or contamination of the contents in the adjacent liner and thereby render the contents unacceptable for recycling. This problem, and others in the presently known systems, indicate that there remains a definite need in the art for improved containers that facilitate separation of recyclable and non-recyclable waste as it is accumulated.

Accordingly, it is an object of the present invention to provide an improved waste collection receptacle having separable sections for receipt of recyclable and non-recyclable waste as it is accumulated.

Another object of the present invention is a waste collection receptacle housing separable compartments for recyclable and non-recyclable refuse.

A further object of the present invention is a novel compartmentalized container for collecting recyclable and non-recyclable refuse.

An additional object of the present invention is a novel divider that supports and maintains two trash can liners in spaced side-by-side adjacency within a waste disposal can.

Another object of the present invention is a separator structure for maintaining two trash can liners in spaced side-by-side adjacency within a waste disposal can.

An additional object of the present invention is a novel closure for a waste disposal can.

SUMMARY OF THE INVENTION

According to the present invention the foregoing and additional objects are attained by providing a dual purpose waste receptacle including an open top trash container, a divider transversely secured to the open top and having structure thereon to support a portion of the open top of two trash can liners in side-by-side relationship to divide the interior of the can into two compartments, and a removable top for the open top container. The remainder of the liner open top portions not supported by the divider, are lapped over the edge lip of the trash container. The divider has an open channel extending substantially the length thereof to receive the portions of the can liners.

A slit opening is provided along substantially the entire length of the divider channel base with at least one separator in the form of an elongated strip of relatively rigid material slidably disposed within the slit opening and extending to substantially the bottom of the container. The structure of the at least one separator permits bending, swinging or a substantially hinged movement, of the separator material adjacent the divider. This movement of the elongated separator permits the separator to provide expansion of the space occupied by one of the trash can liners in the event it receives more accumulated waste, and requires more space, than the other liner. Also, in the event one of the can liners tears, or becomes ruptured by a sharp object, the other can liner is maintained separated therefrom and is less likely to be ruptured by the same object or to have the contents thereof mixed or contaminated by the contents of the ruptured liner.

A removable closure top is provided for the trash can and a transverse bar carried by the removable cover extends into and assists in frictionally retaining the portions of the two trash can liners disposed within the open channel of the divider. The exterior of the removable cover frictionally slides over the edge lip of the container and frictionally secures the remaining portions of the open trash can liners in position thereon. A pair of hinged handles are positioned on the exterior of the removable cover and have portions thereof that extend under the edge lip of the container to permit manual lifting of the container when the removable cover is disposed thereon. A pair of swinging access doors are provided on the removable cover and aligned with the open top end of the two trash can liners. These doors are provided with suitable indicia indicating a recyclable and a disposal or non-recyclable compartment.

BRIEF DESCRIPTION OF THE DRAWINGS

A more complete appreciation of the invention and many of the attendant advantages thereof will be more readily appreciated as the same becomes better understood by reference to the following detailed description when considered in connection with the accompanying drawings wherein.

DETAILED DESCRIPTION

Figure 1:
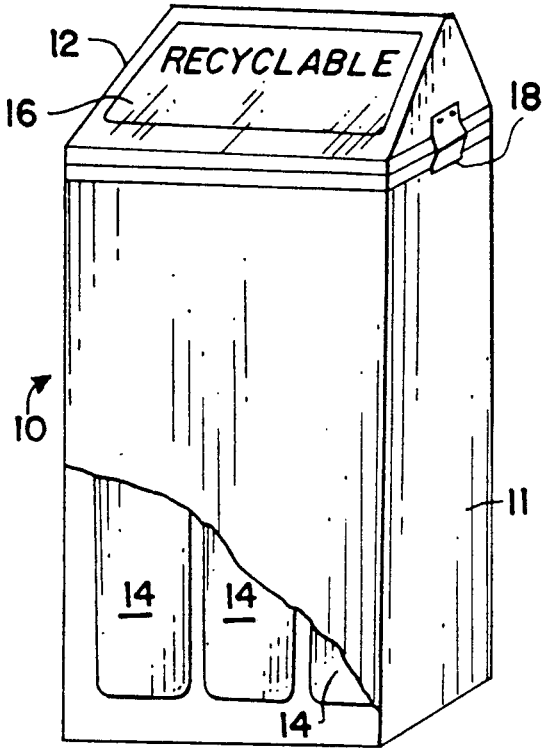
FIG. 1 is a front perspective view of the waste receptacle according to the present invention, with parts thereof broken away, and prior to insertion of the trash can liners.
Figure 2:
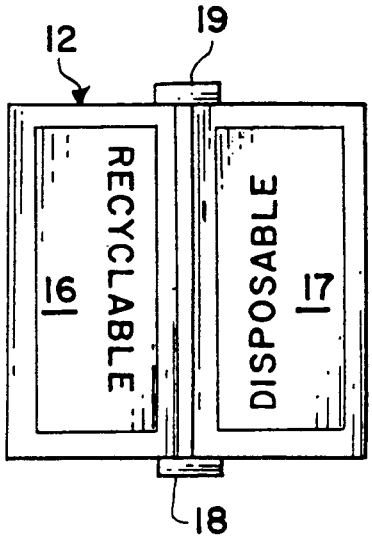
FIG. 2 is a top plan view of the waste receptacle shown in FIG. 1.

Referring now to the drawings and more particularly to FIGS. 1 and 2, the dual purpose waste receptacle of the present invention is shown and designated generally by reference numeral 10. Waste receptacle 10 includes an open top trash container 11 having a removable closure top 12 telescopingly received thereon. At least one depending, elongated, container separator 14 is disposed within container 11, as will be further explained hereinafter. Three such separators 14 are illustrated in FIG. 1.

Closure top 12 is provided with a pair of swinging doors 16, 17 providing access to separate compartments within container 11, as will be further explained hereinafter. Doors 16, 17 are provided with suitable indicia thereon indicating, respectively, "RECYCLABLE" and ""NON-RECYCLABLE". A pair of handles 18,19 are hinged to the exterior of closure top 12 and have portions adapted to extend under the overhanging or lip edge 30 (FIG. 3) of container 11 to permit manual lifting of receptacle 10 when container 11 and closure top 12 are assembled.

Figure 3:
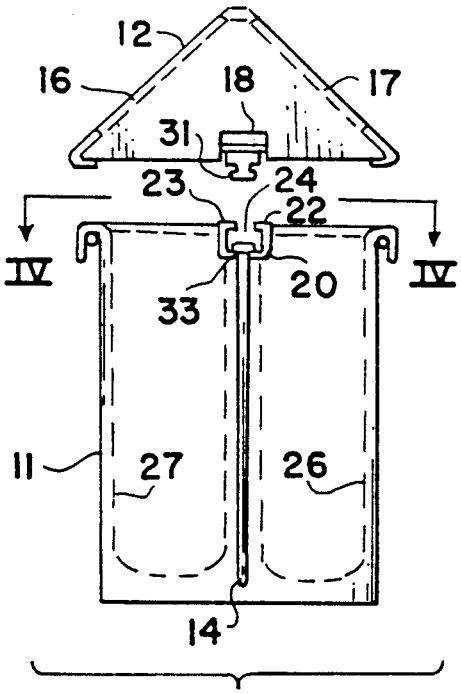
FIG. 3 is a part exploded side view of the trash receptacle shown in FIG. 1 with the can liners installed therein.

Referring now more particularly to FIG. 3, the exploded side view shows a divider 20 that extends transversely across the open top, and at the substantial center, of container 11. Divider 20 is provided with a pair of spaced vertically extending sides 22,23 along the major portion of the length thereof to define an open channel 24. A pair of trash can liners 26,27 are disposed in side-by-side relationship within container 11. A portion of the open tops of each liner 26,27 is positioned over the respective vertical extending sides 22,23 of divider 20 and the remainder of the liner open top portions extending over the lip edge 30 of container 11. An elcngated transverse bar 31 is attached to, and depends from, the bottom of closure top 12, as will be further explained hereinafter. Elongated bar 31 has an exposed length portion that is frictionally received along the length of open channel 24 of divider 20 when closure top 12 is telescopically received by container 11, as will also be further explained hereinafter.

As discussed hereinbefore, one or more container separators 14 are slidably positioned through an open slit 33 provided along a major portion of the length of the base of open channel 25 of divider 20.

Figure 4:
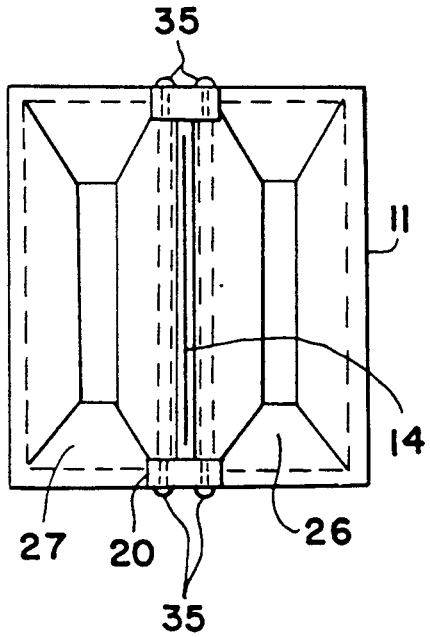
FIG. 4 is a top plan view of the trash receptacle with the top cover removed and with the trash can liners installed therein as seen along lines IV—IV of FIG. 3.

Referring now to FIG. 4, a top view of open container 11 is shown with divider 20 and trash can liners 26,27 installed therein. The top of a single container separator 14 is also visible in this FIG. occupying the entire length of open slit 33 in the base of channel 24 of divider 20. A pair of screws, each designated by reference numeral 35, extend through the sidewall of container 11 into each solid end of divider 20 for securing divider 20 to inside opposed surfaces of container 11. Screws 35 are self-tapping screws and are inserted through predrilled holes in the sidewall of container 11. If desired, previously drilled bores, having a smaller diameter than that of screws 35 may be provided in the solid ends of divider 20 to facilitate tapping thereof by screws 35.

Figure 5:
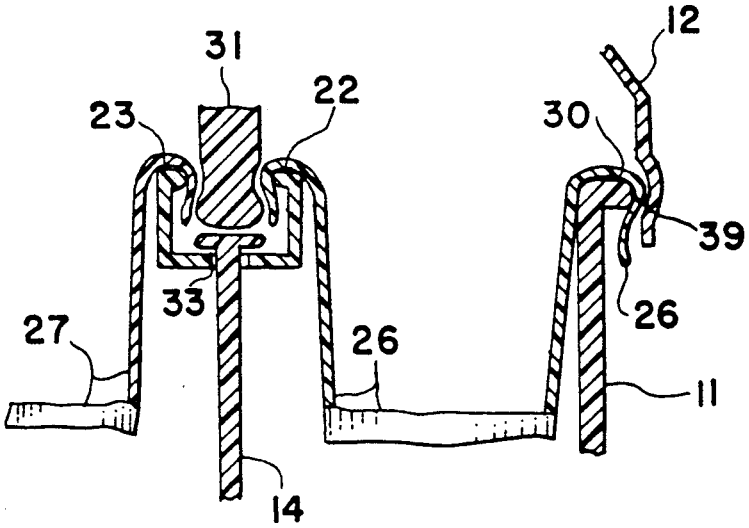
FIG. 5 is a part sectional view of a portion of the trash receptacle with the removable cover and trash can liners installed therein.

Referring now to FIG. 5, a part sectional view of a portion of trash container 11 is shown, with removable cover 12 attached and trash can liners 26,27 installed therein. As shown, separator 14 extends through open slit 33 in the base of divider 20. In the illustrated embodiment, separator 14 terminates in an enlarged or spread end that serves to contact divider 20 and maintain separator 14 suspended slightly from the bottom of container 11. In some instances, the enlarged or spread end is omitted and separator 14 provided with a length that reaches the bottom of container 11. In either construction, the free end of separator(s) 14 adjacent, or in contact with, the bottom of container 11 is free to undergo pivotal or bending movement about the end disposed within slit 33 to permit altering the relative volume of the compartments separated thereby. Thus, for example, if the contents of trash can liner 26 exceed the contents of, and requires more space than, trash can liner 27, separator(s) 14 may bend, pivot or otherwise have portions thereof forced toward liner 27 to permit liner 26 and its contents to occupy more than half the volume of container 11. Also, if one of the trash can liners is ruptured or torn by a sharp object, separator(s) 14 serves as a barrier and maintains the liners essentially separated to reduce the likelihood of the other liner being ruptured by the same object with subsequent commingling and/or contamination of the liner contents.

As discussed hereinbefore, elongated bar 31 extends from closure top 12 and is frictionally received within open channel 24 of divider 20 to assist in retention of the top portions of trash can liners 26,27 disposed therein. The vertical sides 22,23 of divider 20 are provided with in-turned edges, or protrusions, that mate with a pair of grooves extending along the length of bar 31. When top 12 is positioned on container 11, the enlarged end or edge of bar 31 forces vertical sides 22,23 of divider 20 to bend or spring open adequately to permit insertion thereof. When bar 31 reaches the necessary depth within channel 24 for the linear grooves thereon to mate with the in-turned edges, or linear protrusions, on vertical sides 22,23, they return or spring back to their original position and frictionally capture bar 31 therein. This releasable, frictional, contact assists in maintaining the open ends of trash can liners 26,27 in fixed retention while also serving to assist in maintaining closure top 12 on container 11.

As discussed hereinbefore, container 11 is provided with a peripheral overhang or lip edge 30 at the open end thereof. Closure top 12 is provided with a mating internal peripheral groove 39 that telescopingly slides over and frictionally engages lip edge 30 when top 12 is positioned on container 11. Groove 39 extends completely around closure top 12 except for the spacing thereon for handles 18,19.

Figure 6:
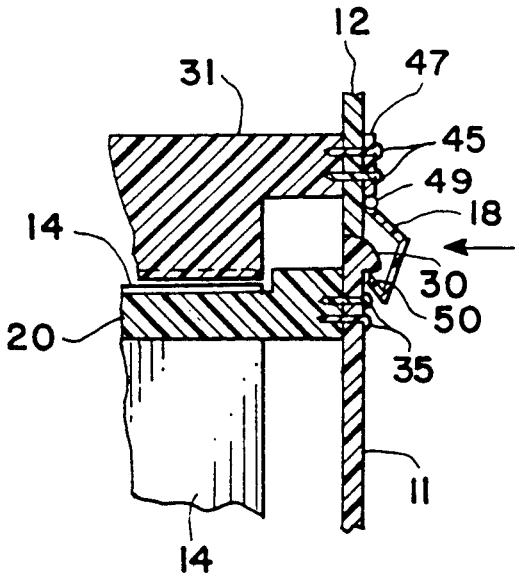
FIG. 6 is a part sectional view taken along line VI—VI of FIG. 7.
Figure 7:
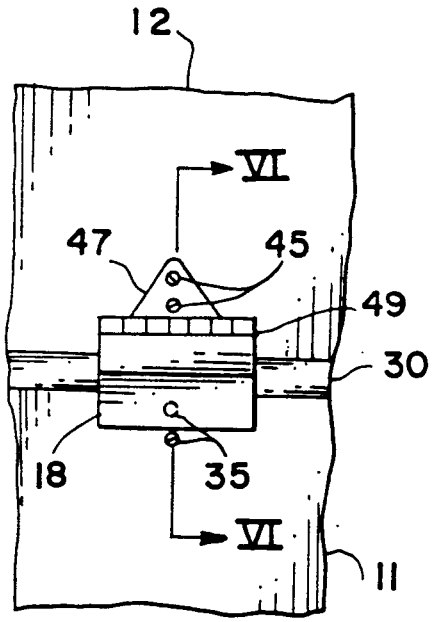
FIG. 7 is a view of a segment of the waste receptacle of the present invention looking in the direction of the arrow of FIG. 6.

Referring now to FIG. 6, a part sectional view taken along line VI—VI of FIG. 7 is shown. As illustrated therein, one end of elongated bar 31 is attached to closure top 12 by a pair of screws 45. Screws 45 also serve to secure hinge bracket 47 for handle 18 to closure top 12, as shown more clearly in FIG. 7. A piano type hinge 49 serves to connect handle 18 to hinge bracket 47 in a conventional manner. Screws 45 are self tapping type screws and are inserted through predrilled holes in the sidewall of closure top 12 and hinge bracket 47. If desired, suitable previously drilled bores, having a smaller diameter than screws 45, may be provided in the solid ends of elongated bar 31 to facilitate tapping thereof by screws 45. The structure and attachment for the other end of bar 31 and handle 19 are identical to that described herein for the attachment of the illustrated end of bar 31 and handle 18, and are not described further in the interest of brevity.

As illustrated in FIG. 6, the depending portion of bar 31 that is received by channel 24 in divider 20 does not extend completely to the ends thereof. This is essential since, as described hereinbefore, channel 24 terminates short of the solid ends of divider 20. These solid ends are necessary for the receipt of attachment screws 35.

Handle 18, as illustrated, is pivotal about hinge 49 and is provided with a free terminal end essentially in the form of a hook, or up-turned portion 50, extending the entire width thereof and adapted to be received beneath the lip edge 30 on container 11 when closure top 12 is postioned thereon. As discussed hereinbefore, the structure forming internal groove 39 is omitted from top 12 in the area occupied by handles 18,19 to permit unobstructed engagement of end 50 with lip edge 30 on container 11. Thus, when top 12 is attached to container 11, handles 18,19 are freely pivotal about their respective hinges to permit the hook termini 50 thereof to move beneath and engage lip edge 30 on container 11 and permit manual lifting and movement thereof. If desired, suitable finger shaped indentations (not shown) may be provided on the exterior surfaces of handles 18,19 to improve hand engagement thereof.

The operation of the present invention is believed apparent from the above description. An open container 11 is provided and a divider 20 installed transversely across the open top thereof via screws 35. One or more relatively rigid separators 14 are slidably positioned through slit 33 at the base of channel 24 of divider 20. When separators 14 are provided with the spread or wide top end, as in the illustrated embodiment of FIG. 5, separators 14 are suspended slightly from the bottom surface of container 11. Alternately, the spread end may be omitted and separators 14 provided with a length that has one end resting on the bottom of container 11 and the other end disposed within slit 33 of divider 20.

Trash can liners 26,27, formed of conventional plastic or paper, are disposed in side-by-side relationship within container 11 and on opposite sides of separator(s) 14. The open top ends of liners 26,27 are positioned over vertical extending sides 22,23 of divider 20 and over lip edge 30 of container 11. Liners 26,27 may or may not extend over the portion of lip edge 30 that receives ends 50 on handles 18,19 of closure top 12.

Closure top 12 is then telescopingly positioned on container 11 with transverse elongated bar 31 carried thereby being forcibly inserted into channel 24 formed by vertical sides 22,23 of divider 20. The periphery of closure top 12 frictionally extends over lip edge 30 of container 11 to assist in maintaining can liners 26,27 in position therein. Handles 18 and 19 are hingedly positioned with ends 50 thereon being frictionally inserted beneath lip edge 30 on container 11. Handles 18 and 19 are constructed and arranged to flex sufficiently to permit hook ends 50 to releasably snap or lock beneath lip edge 30 on container 11. For manual lifting of container 11 and attached top 12, a vertical force is applied to the handles and, for release of top 12 from container, a horizontal force is applied to the hook ends 50. This horizontal force causes handles 18,19 to flex sufficiently to release the hook ends 50 from beneath lip edge 30.

Although the invention has been described relative to specific embodiments, it is not so limited and there are many variations and modifications thereof that will be readily apparent to those skilled in the art in the light of the above teachings without departing from the spirit and scope of the invention.

For example, the indicia on swinging access doors 16,17 of top 12 may be as illustrated or may be detailed for specific recyclable and non-recyclable items. Separator(s) 14 in the preferred embodiments are formed of relatively thick conventional plastic material, such as polyethylene or polyvinyl sheets, and serve to maintain trash can liners 26,27 essentially out of contact with each other and confined to one compartment of container 11. Due to the swinging or pivotal movement permitted by the insertion of separators(s) 14 through slit 33 in divider 20, the two compartments formed in container 11 are not of fixed dimensions. Thus, if the contents of one can liner exceed the volume of the compartment in which it is positioned separator(s) 14 flex or pivot at the top end thereof to permit side expansion of one of the compartments. Also, in the event a sharp object punctures, or ruptures one of the trash can liners, separator(s) 14 reduce the likeihood of the same object puncturing the other can liner and causing commingling of the can liner contents. In the embodiment of FIG. 1 three separators 14 are employed, while in the embodiment illustrated in FIG. 4, the use of a single separator 14 is shown. These numbers are not fixed and any reasonable number of separators 14 may be employed in different situations. Also, in some instances, depending upon the waste to be collected, no separators are needed and they may be omitted completely.

The component parts of the dual purpose waste receptacle 10 of the present invention may be marketed in assembled or unassembled form with assembly requiring only the use of a simple screw driver for screws 35 and 45. Containers 11 preferably are molded or otherwise conventionally formed and are provided with the closed bottom end being slightly smaller than, and tapering toward, the open top to permit stacking of the containers for shipping purposes. Also, dividers 20 may be employed on existing trash containers with, or without, the use of transverse elongated bar 31 to retro fit or convert existing trash containers into divided compartments for separating recyclable and non-recyclable waste, as accumulated.

No specific materials have been mentioned for manufacturing the components parts, it being understood that any suitable plastic or lightweight metal may be employed for the various components that have the necessary physical property characteristics to perform the functions described. For example, suitable plastic or paper trash can liners may be employed for liners 26,27 and any suitable plastic or lightweight metal having the required physical property characteristics may be employed for container 11, closure top 12, hinge handles 18,19 and their connected parts.

Thus, numerous variations and modifications of the present invention will be readily apparent to those skilled in the art and are considered within the scope of the present invention.

It is therefore to be understood that, within the scope of the appended claims, the invention may be practiced other than as specifically described herein.

What is claimed as new and desired to be secured by Letters Patent of the United States is:

1. Apparatus for receiving and maintaining separate recyclable and non-recyclable refuse, as accumulated, comprising in combination:

a trash container having an open top end and a closed bottom end;

divider means carried by said open top end of said trash container;

two trash can liners supported by said divider means in side-by-side relationship and serving to divide the interior of said trash container into two separate compartments;

said divider means having spaced vertically extending edges defining an elongated open channel extending the length of said divider means and facing the open top end of said trash container;

a pair of linear protrusions formed on opposite sides of said vertically extending edges;

said open channel of said divider means receiving a portion of the top of each of said two trash can liners in overlapping relationship thereon;

a removable cover for said trash container serving to selectively cover said open top end thereof;

said removable cover being provided with first and second doors;

said first door being aligned with and providing access to one of said two trash can liners and said second door being aligned with and providing access to the other of said two trash can liners;

a transverse elongated bar extending over a central portion of the open top end and supported by said removable cover;

said transverse elongated bar including a depending elongated portion;

said depending elongated portion having a pair of grooves on opposite sides of said elongated bar and disposed along the length thereof and disposed in frictional mating engagement with said linear protrusions of said divider means when said removable cover is positioned on said trash can to thereby assist in maintaining said two trash can liners releasably attached to said divider means and to releasably secure said removable cover in position on said open top end of said trash container.

2. The apparatus of claim 1 including;

said trash container being provided with a lip edge overhanging the peripheral exterior surface of said open top end;

each of said two trash can liners having portions thereof extending over said lip edge;

said removable cover having a peripheral interior surface that slides over and frictionally engages said lip edge of said trash container to thereby grip and maintain said trash can liners in position when said removable cover is positioned on said trash can;

handle means disposed on said removable cover to permit manual lifting and movement of said trash container when said removable cover is positioned on said trash container;

said handle means having portions thereof extending beneath and frictionally engaging said lip edge extending over the peripheral exterior surface of said open top end of said trash container.

3. The apparatus of claim 1 including at least one plastics sheet of material releasably retained by and depending from said divider means, said at least one plastic sheet of material having sufficient rigidity to maintain said two trash can liners supported by said divider means separate from each other.

4. The apparatus of claim 3 wherein said divider means is provided with an elongated slit at the base of the elongated open channel and one end of said plastic sheet is retained within said elongated slit.

5. A waste receptacle comprising:

a trash container having an open top end and a closed bottom end;

a divider transversely secured to said open top end of said container;

a pair of trash can liners disposed in side-by-side relationship within said trash container and releasably supported by said divider;

a removable top telescopingly received on said trash container to close said open top end;

handle means carried by said removable top and engaging portions of said trash container when said removable top is received thereon;

means carried by said removable top to frictionally connect with said divider and assist in maintaining said pair of trash can liners in releasably supported position on said divider;

said removable top including a pair of spaced doors each of said pair of spaced doors being aligned with and providing access to one of said two trash can liners;

indicia on said pair of spaced doors indicating the type of waste intended to be received therethrough;

said divider having solid end portions and a pair of spaced vertically extending linear edges disposed along the length and between said solid end portions of said divider to form an open channel facing the open end of said container;

said divider also including a base portion connecting said pair of spaced vertically extending linear edges and an elongated open slit extending substantially the length of said base portion;

at least one elongated separator element extending through said elongated open slit and disposed between and maintaining side-by-side separation of said pair of trash can liners;

said divider includes linear protrusions formed on opposite sides of said linear edges;

a transverse bar connected to and having an elongated portion thereof depending from said removable top and extending over a central portion of said open top end;

said elongated portion of said transverse bar having a pair of linear grooves disposed on opposite side of and along the length thereof; and said linear grooves matingly receiving said linear protrusions formed on said linear edges of said divider.

6. The waste receptacle of claim 5 wherein said transverse bar connected to said removable top has end portions abutting opposite inside surfaces of said top;

a pair of brackets disposed on the exterior surface of said top;

a hinge member carried by each of said pair of brackets;

said handle means including a handle hingedly connected to each said hinge member;

at least a pair of screw members extending through each of said pair of brackets and said removable top; and said at least a pair of screw members also engaging said end portions of said transverse bar.

* * * * *